US006055914A

United States Patent [19]

Wark

[11] Patent Number: 6,055,914

[45] Date of Patent: May 2, 2000

[54] PRE-RIFFLE BOX MIXING DEVICE FOR COAL-FIRED POWER PLANT

[75] Inventor: Rickey E. Wark, The Woodlands, Tex.

[73] Assignee: Sure Alloy Steel Corporation, Madison Heights, Mich.

[21] Appl. No.: 08/987,646

[22] Filed: Dec. 9, 1997

[51] Int. Cl.[7] ..... F23K 3/00; F23K 3/02

[52] U.S. Cl. ..... 110/104 R; 110/101 R; 110/106

[58] Field of Search ..... 110/101 R, 102, 110/104 R, 105, 106, 108, 267, 293, 292, 294

[56] References Cited

U.S. PATENT DOCUMENTS

| | | | |
|---|---|---|---|
| 391,873 | 10/1888 | Allington | 110/102 |
| 1,120,534 | 12/1914 | Pruden | 110/104 R X |
| 1,315,719 | 9/1919 | Grindle | 110/104 R |
| 1,318,375 | 10/1919 | Goff | 110/105 |
| 2,184,297 | 12/1939 | Grindle | 110/104 R X |
| 2,510,240 | 6/1950 | Mayo | 110/105 |
| 4,256,044 | 3/1981 | Burton | 110/104 R |
| 5,463,967 | 11/1995 | Gielow et al. | 110/267 X |
| 5,645,381 | 7/1997 | Guidetti et al. | 110/104 R X |

FOREIGN PATENT DOCUMENTS

| | | | |
|---|---|---|---|
| 247350 | 12/1960 | Australia | 110/104 R |
| 735373 | 11/1932 | France | 110/104 R |
| 822453 | 12/1937 | France | 110/104 R |
| 1158898 | 12/1963 | Germany | 110/104 R |
| 63-259316 | 10/1988 | Japan | 110/106 |

*Primary Examiner*—Ira S. Lazarus
*Assistant Examiner*—Ljiljana V. Ciric
*Attorney, Agent, or Firm*—Young & Basile, P.C.

[57] ABSTRACT

In a coal-fired power plant having an exhauster fan for delivering coal/air flow through a discharge chute to a combustion chamber and further having a riffle box in the discharge chute, a mixing device located in the discharge chute between the exhauster fan and the riffle box for causing heavy and light distribution regions of the coal/air flow from the fan to converge upstream of the riffle box, thereby mixing them into a more homogeneous flow. In a preferred form, the device comprises a plurality of concentric, inwardly-angled rings located in the discharge chute to cause the heavy and light distribution regions of coal/air flow to converge after passing through the rings.

5 Claims, 3 Drawing Sheets

PRE-RIFFLE BOX MIXING DEVICE FOR COAL-FIRED POWER PLANT

FIELD OF THE INVENTION

This invention is in the field of equipment for delivering pulverized coal to coal-fired power plants, and more particularly relates to the delivery chutes through which the coal travels from an exhauster fan to the Combustion chamber.

BACKGROUND OF THE INVENTION

Before being fed into a power plant combustion chamber, coal is pulverized into dust-like "fines" by a pulverizer, and then forced by a powerful exhauster fan from the pulverizer through a branched arrangement of ducts or chutes which feed burner nozzles in the combustion chamber. The exhauster fan first throws the coal radially into a primary discharge chute. The coal/air flow leaving the exhauster fan is uneven, in that the heaviest particles tend to be radially centrifuged out toward the back or bottom of the exhauster outlet, and against one side or wall of the chute. Accordingly, the coal/air flow leaving the fan and proceeding down the chute to the burners tends to be light on one side and heavy on the other side in terms of both particle size and distribution.

The prior art solution has been to provide "riffle boxes" in the chute between the fan and the burners. A riffle box is a series of vertical, spaced plates separated by angled separator bars with alternating orientation from plate to plate. The theory is that the separator bars on one plate will deflect the coal in one direction, while the separator bars on adjacent plates will deflect the coal in the opposite direction, thereby splitting and redistributing the flow for a more homogeneous mixture. The typical arrangement is to provide a series of riffle boxes, with a first riffle box splitting the flow like a "Y" into two chute branches, and a subsequent riffle box on each of the first two branches splitting the flow again into a total of four chutes. Each chute typically fuels one of four corner-mounted burners in a tangentially-fired combustion chamber (best shown in FIG. 2).

The riffle boxes have proven ineffective in providing a more homogeneous mixture to the burners, and the coal/air flow reaching the four combustion chamber burners differs significantly from burner to burner. Several problems result: too lean a mixture at a burner can create NOX; oversized particles and inefficient burning create LOI (loss on ignition) contamination of the ash byproduct and reduced combustion efficiency; and, perhaps most importantly, the out-of-balance burner flow distorts the combustion chamber fireball from the ideal spherical shape to an undesirable elliptical shape, creating hot and cold spots in the boiler tubes and causing gas control problems.

SUMMARY OF THE INVENTION

It is therefore desirable to provide a uniform coal/air flow to each burner, with uniform fineness of coal, uniform volume of coal, and uniform volume of air. In its broadest form, my invention solves the above-described problem with what I call my "Imploder™" mixing device placed in the discharge chute upstream of the first riffle box to cause the coal/air flow mixture to converge on itself prior to entering the first riffle box. In one embodiment, my invention is a preferably cylindrical housing inserted in the discharge chute between the exhauster fan and the first riffle box, and includes a number of concentric, inwardly-angled diverter rings which force the coal/air flow in on itself, "imploding" it and thoroughly mixing it before it hits the first riffle box.

While it is possible to use my invention elsewhere in a typical series of riffle boxes between the exhauster fan and the combustion chamber, its primary benefit is believed to be upstream of the first riffle box in the series.

DETAILED DESCRIPTION OF THE ILLUSTRATED EMBODIMENT

Figure 1:
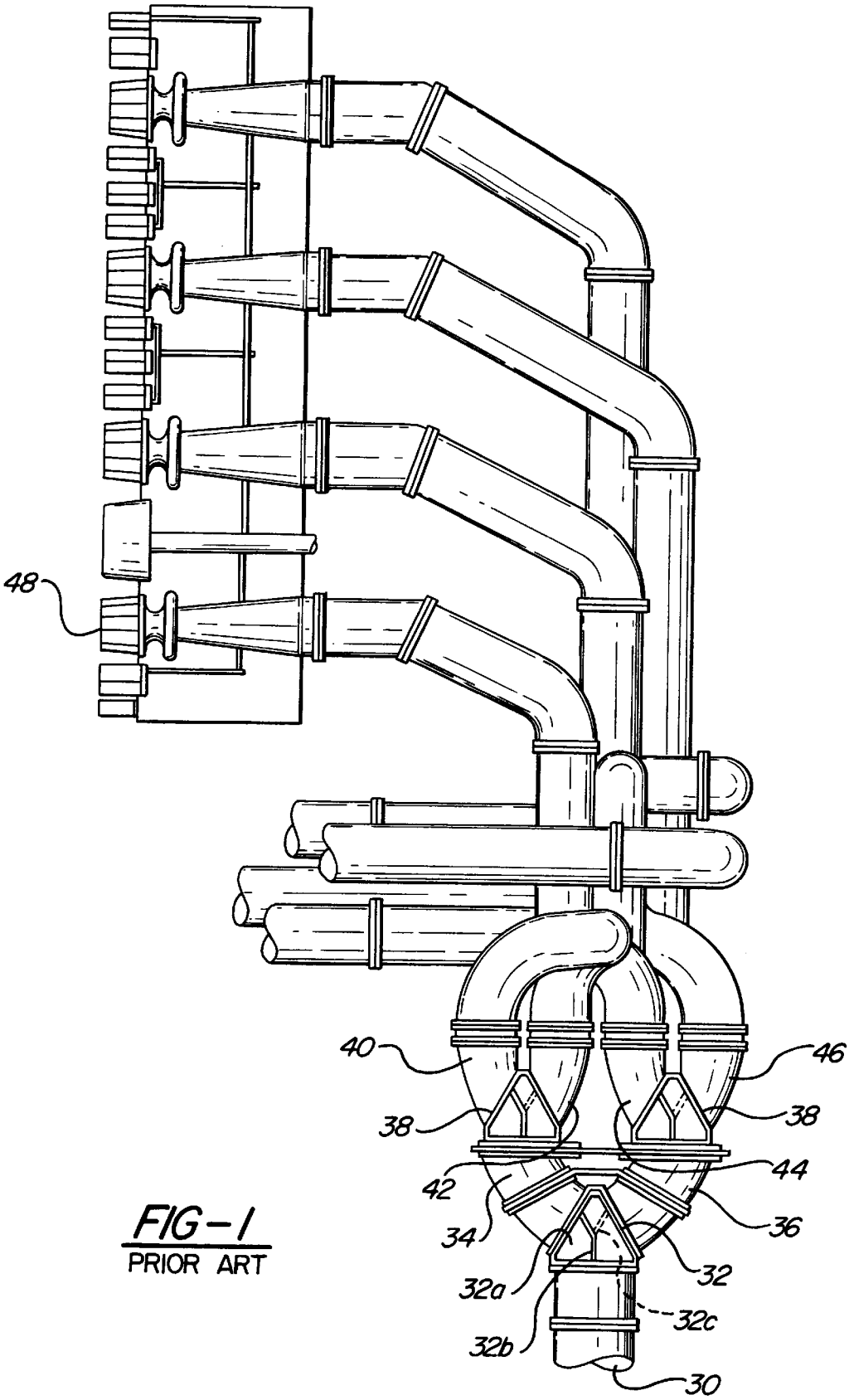
FIG-1 PRIOR ART
FIG. 1 is a schematic illustration of a discharge chute arrangement between the exhauster fan and a four-burner combustion chamber according to the prior art, including a series of riffle boxes.

Referring first to FIG. 1, a typical prior art chute and riffle box arrangement is shown feeding a four-burner nozzle system. FIG. 1 is a schematic representation, and with respect to the burner nozzles illustrates one corner of a combustion chamber in which four tiers of corner-mounted burner sets are stacked one on top of the other.

The discharge chute begins as a single chute 30 near the outlet of an exhaust fan 12, feeding into a primary riffle box 32 comprising a spaced series of vertical, somewhat triangular riffle plates 32*a* spaced by angled separator bars 32*b*, 32*c* whose angle alternates from plate to plate. Riffle boxes are well known in the art, and further explanation of their structure is not necessary.

Figure 2:
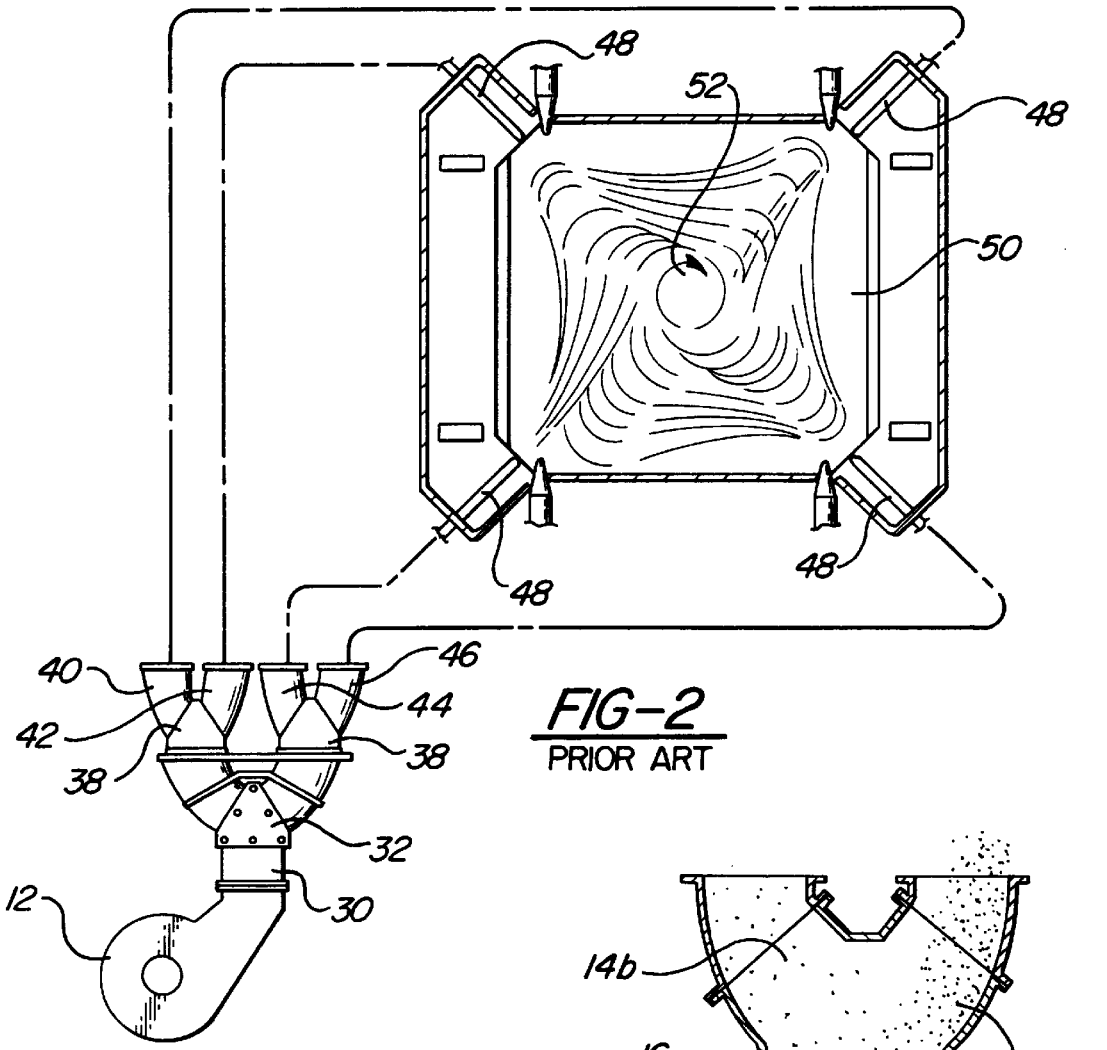
FIG-2 PRIOR ART
FIG. 2 is a schematic plan view representation of a tangentially-fired, four-burner combustion chamber being fed through a typical discharge chute arrangement.

The angled separator bars of primary riffle box 32 are designed to split the flow from main chute 30 into two chute branches 34, 36. Branches 34, 36 are in turn split by secondary riffle boxes 38 into four chute branches 40, 42, 44, 46 which feed each of the four burner nozzles in a four-corner array. In FIG. 1, only the lowermost burner nozzle 48 is part of the four-corner array fed by discharge chutes 40, 42, 44, 46. A typical four-corner array of burner nozzles 48 for a tangentially-fired combustion chamber 50 is best illustrated in FIG. 2.

In theory, the riffle boxes 32, 38 shown in FIG. 1 are supposed to split the coal evenly at each branch in the discharge chutes, resulting in four homogeneous flows of coal/air to each of the four burner nozzles in the array fed by that exhauster fan. In practice, the coal/air flow to each of the four burners 48 in the array varies widely due to the uneven coal/air flow reaching the primary riffle box 32, and the subsequent failure of the riffle boxes to split the initially uneven flow into more homogeneous flows.

Figure 3:
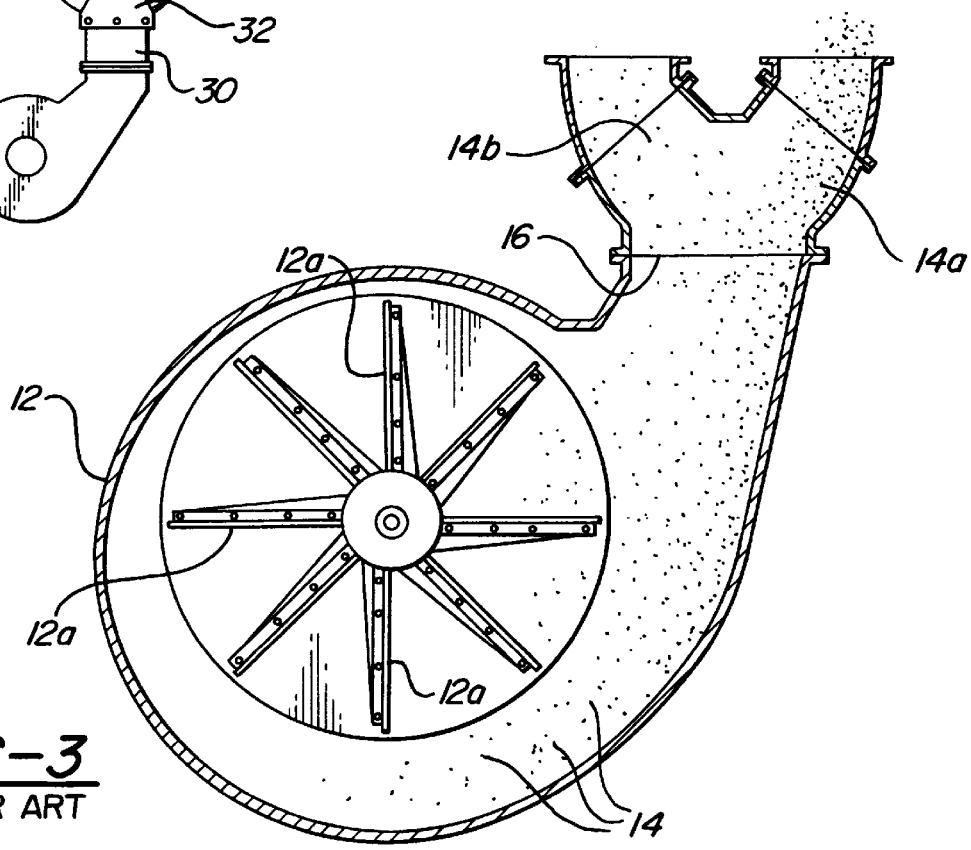
FIG-3 PRIOR ART
FIG. 3 is a schematic sectional view of an exhauster fan and the uneven coal distribution initially occurring at its outlet; and, FIG. 4 is a sectional view of an embodiment of my invention inserted into the discharge chute between the exhauster fan outlet and the first riffle box.

Referring to FIG. 3, the uneven nature of the initial coal/air flow from the exhauster fan 12 to the discharge chute is schematically illustrated with a shortened discharge chute. Radial fan blades 12*a* throw the pulverized coal fines 14 radially toward exhauster outlet 16, with the result that the heavier distribution of fines 14*a* is concentrated radially outward toward the outer wall of the fan and chute and into the right-hand branch, and the lighter distribution of fines

14*b* is concentrated toward the inside left. Recalling FIG. 2, it will be understood that every split of this initially uneven coal/air flow, coupled with the failure of the riffle boxes to re-integrate the flow into a more homogeneous mixture, results in a marked imbalance among the four corner-mounted burner nozzles 48 in combustion chamber 50. This in turn can have a significant and serious effect on the ideally spherical fireball 52 which is the goal of the tangentially-fired combustion chamber. This uneven flow can also create the NOX and LOI problems discussed above.

Figure 4:
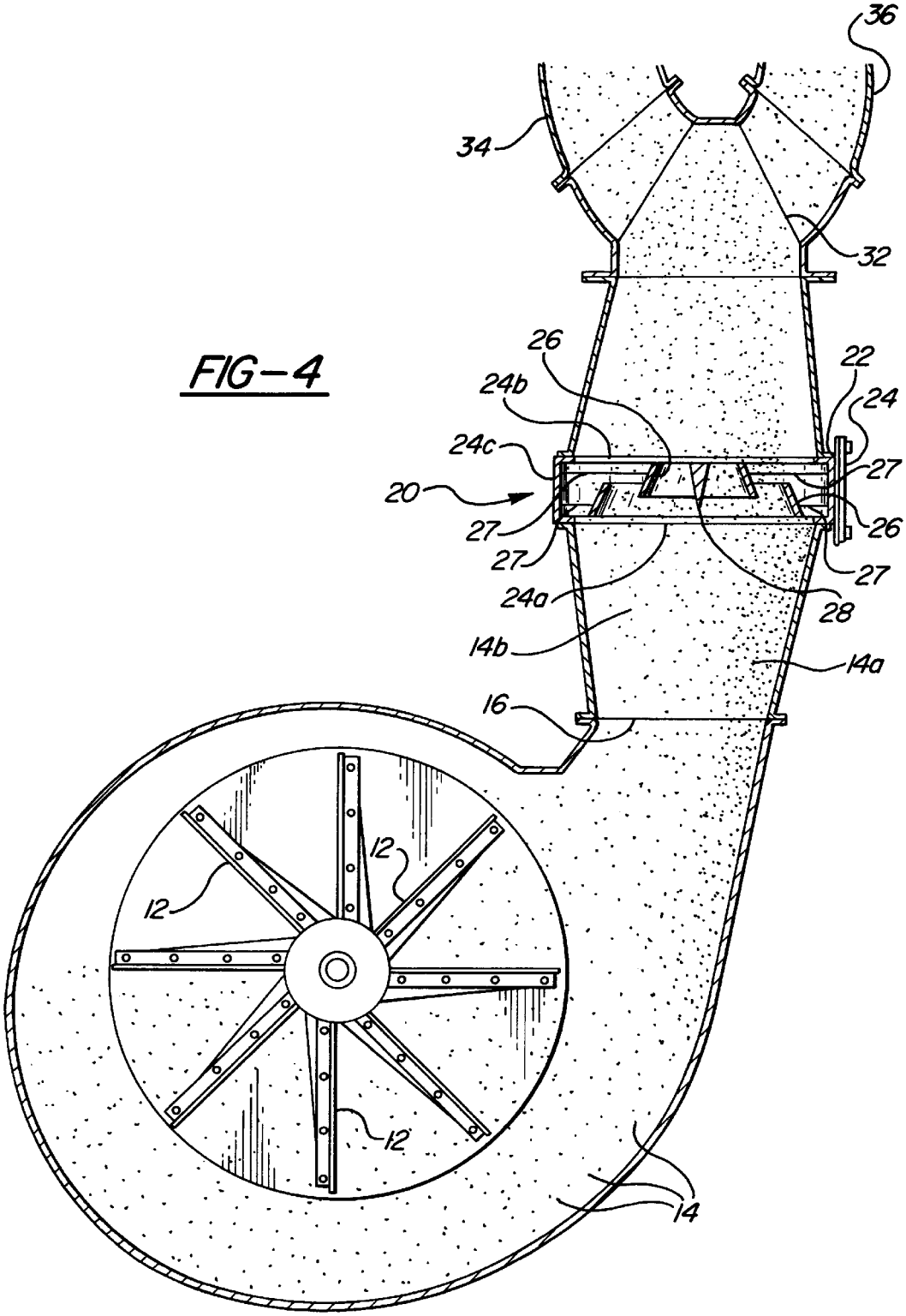

FIG. 4, however, illustrates the present invention inserted upstream of the primary riffle box in the main discharge chute 30 from the exhauster fan 12. Mixing device 20 is illustrated as a housing 24 removably inserted into a slot or opening 22 in discharge chute 30. Housing 20 is preferably formed of a material similar to that used for the chute, namely a wear-resistant steel of known type capable of withstanding the abrasive coal flow. In the illustrated embodiment, housing 20 is preferably a circular housing with an inlet side 24*a* and an outlet side 24*b* between which are located a plurality of concentric, inwardly-angled diverter rings 26. Rings 26 are secured in place, for example, by radial ribs or spokes (schematically illustrated at 27) extending from the sides of the rings at several points to the outer sidewall 24*c* of the housing.

Inwardly-angled diverter rings 26 are also preferably formed from a wear-resistant steel, and are angled sufficiently that they form deflector surfaces which cause the uneven coal flow (heavy distribution 14*a* and light distribution 14*b*) to converge or "implode" on itself downstream of the mixing device before it reaches the first riffle box 32. This converging action re-mixes the uneven distributions of coal/air flow into a homogeneous flow which can be evenly split by the riffle boxes among the four discharge chutes leading to the combustion chamber burners. The rings 26 are of sufficient diameter that their angled deflector surfaces are in the path of at least portions of both the heavy and light distributions of coal/air flow 14*a,* 14*b*.

In the embodiment of FIG. 4, the mixing device is also shown with a diverging-type pilot element 28 in its center to further enhance mixing action by creating additional implosion regions within the main converging flow downstream of housing 24.

The present invention solves the problem of properly feeding the riffle boxes, which are the best mechanical devices available for splitting the flow among the four discharge chutes leading to the combustion chamber, but which have not been capable of re-integrating the uneven flow from the exhauster fan. It will be understood by those skilled in the art that the specific illustrated embodiment of my invention shown in FIG. 4 is not intended to limit my invention beyond the scope of the following claims, since the specific structural embodiment of the mixing device is subject to modification in terms of materials, size, dimensions and angles, numbers of rings (or other deflector surface shapes), and other changes which will be apparent to those skilled in the art.

Accordingly, I claim:

1. In a system for providing coal/air flow to a coal fired power plant combustion chamber having an exhauster fan, a discharge chute and a riffle box, an apparatus for providing a homogeneous coal/air flow to the riffle box comprising:

a first deflector surface located in the discharge chute downstream of the exhauster fan in a portion of the discharge chute corresponding to a heavy distribution of coal/air flow, and a second deflector surface located in the discharge chute, the second deflector surface being radially spaced from the first deflector surface, the second deflector surface further being located in a portion of the discharge chute corresponding to a light distribution of coal/air flow, the first and second deflector surfaces being angled radially inwardly in the discharge chute toward a convergent point in the discharge chute downstream of the first and second deflector surfaces to redirect the heavy and light distributions of coal/air flow to radially converge on one another in the discharge chute upstream of the riffle box, the first and second deflector surfaces further being spaced radially from the internal surface of the discharge chute.

2. The apparatus of claim 1, wherein the apparatus comprises a first deflector ring having an inner annular surface including the first and second deflector surfaces and having a first diameter sufficient to encompass portions of both the heavy and the light distributions of the coal/air flow.

3. The apparatus of claim 2, wherein the apparatus further includes a second deflector ring of a second diameter different than the first, the second deflector ring being radially spaced from and located concentrically relative to the first deflector ring in the discharge chute.

4. For use in a coal-fired power plant having an exhauster fan, a discharge chute and a riffle box, a device for providing a homogeneous coal/air flow to the riffle box, comprising:

a plurality of radially-spaced deflector rings in the discharge chute between the exhauster fan and the riffle box, the rings each having a diameter sufficient to encompass at least portions of heavy and light distributions of the coal/air flow in the discharge chute from the exhauster fan, the deflector rings being angled radially inwardly to cause the heavy and light distributions of the coal/air flow to radially converge upon one another in the discharge chute upstream of the riffle box, thereby mixing the heavy and light distributions of coal/air flow into a homogeneous mixture prior to reaching the riffle box.

5. The apparatus of claim 4, wherein the deflector rings are mounted in a housing which is removably located in the discharge chute.

* * * * *